US011001463B2

(12) United States Patent
Yaginuma et al.

(10) Patent No.: US 11,001,463 B2
(45) Date of Patent: May 11, 2021

(54) MEDIUM SUPPLY APPARATUS AND IMAGE FORMING APPARATUS

(71) Applicant: FUJI XEROX CO., LTD., Tokyo (JP)

(72) Inventors: Shinji Yaginuma, Kanagawa (JP); Yasunobu Goto, Kanagawa (JP); Kei Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 13 days.

(21) Appl. No.: 16/294,936

(22) Filed: Mar. 7, 2019

(65) Prior Publication Data

US 2020/0087088 A1 Mar. 19, 2020

(30) Foreign Application Priority Data

Sep. 13, 2018 (JP) ..... JP2018-171445

(51) Int. Cl.
*B65H 1/04* (2006.01)
*B65H 1/26* (2006.01)
*G03G 15/00* (2006.01)

(52) U.S. Cl.
CPC ..... *B65H 1/26* (2013.01); *B65H 1/04* (2013.01); *G03G 15/00* (2013.01)

(58) Field of Classification Search
CPC .... B65H 2405/115; B65H 2405/11164; B65H 1/266; B65H 1/04
See application file for complete search history.

(56) References Cited

U.S. PATENT DOCUMENTS 5,313,257 A * 5/1994 Kashima ..... B65H 1/04 271/164
8,366,098 B2 * 2/2013 Kobayashi ..... B65H 1/266 271/145
2014/0153963 A1 * 6/2014 Yamamoto ..... G03G 21/1633 399/107

FOREIGN PATENT DOCUMENTS

JP 2008056397 A * 3/2008
JP 2011-116491 6/2011
JP 2016-117585 6/2016

* cited by examiner

*Primary Examiner* — Luis A Gonzalez
(74) *Attorney, Agent, or Firm* — JCIPRNET

(57) ABSTRACT

A medium supply apparatus includes a box member and a lid. A medium is stored inside the box member. The box member is inserted into and extracted from a body of an image forming apparatus, and has a length in an extraction/insertion direction that is longer than a length of the body in the extraction/insertion direction. The lid is provided on a back side of the body in the extraction/insertion direction of the box member to cover at least an upper part of a portion of the box member that projects from the body. The lid includes a first member, a second member, and a first lug. The first member is movable in the extraction/insertion direction with respect to the body. The second member is connected to the first member so as to be relatively movable in the extraction/insertion direction with respect to the first member. The second member is moved by being pushed by the box member which is inserted into the body. The first lug is provided on the second member. The first lug is engaged with the box member by a force that presses the box member against the second member, and disengaged from the box member by a force that extracts the box member from the second member.

8 Claims, 14 Drawing Sheets

MEDIUM SUPPLY APPARATUS AND IMAGE FORMING APPARATUS

CROSS-REFERENCE TO RELATED APPLICATIONS

This application is based on and claims priority under 35 USC 119 from Japanese Patent Application No. 2018-171445 filed Sep. 13, 2018.

BACKGROUND

(i) Technical Field

The present disclosure relates to a medium supply apparatus and an image forming apparatus.

(ii) Related Art

There has hitherto been known a medium supply apparatus that stores a medium on a tray that is longer than the depth of a body of an image forming apparatus to supply the medium to the body.

Japanese Unexamined Patent Application Publication No. 2016-117585, for example, discloses a dustproof covering disposed over a manual feed tray and having a supported portion supported by an image forming apparatus. The dustproof covering includes a covering part and an extended covering part that cover a paper placement surface of the manual feed tray and an upper side and lateral sides of an extended tray.

Meanwhile, Japanese Unexamined Patent Application Publication No. 2011-116491, for example, discloses an image forming apparatus in which a stopper member actuates a covering moving mechanism by following operation to mount a paper feed cassette extended from a standard form to an extended form to an apparatus body to move a dust covering to a position at which the dust covering covers the paper feed cassette.

SUMMARY

There is a desire to reduce a space for storage of a dustproof covering (lid) for convenience of the arrangement of constituent elements in an image forming apparatus or the like. Therefore, a dustproof lid of an expandable/contractible structure formed from a plurality of members is conceivable. However, a configuration in which a lid is contracted as a paper feed cassette (box member) is extracted from an image forming apparatus body is not known.

Aspects of non-limiting embodiments of the present disclosure relate to providing a medium supply apparatus and an image forming apparatus that allow a lid to be contracted as a box member is extracted.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a medium supply apparatus including: a box member inside which a medium is stored and which is inserted into and extracted from a body of an image forming apparatus, the box member having a length in an extraction/insertion direction that is longer than a length of the body in the extraction/insertion direction; and a lid provided on a back side of the body in the extraction/insertion direction of the box member to cover at least an upper part of a portion of the box member that projects from the body, in which the lid includes a first member that is movable in the extraction/insertion direction with respect to the body, a second member connected to the first member so as to be relatively movable in the extraction/insertion direction with respect to the first member, the second member being moved by being pushed by the box member which is inserted into the body, and a first lug provided on the second member, the first lug being engaged with the box member by a force that presses the box member against the second member and disengaged from the box member by a force that extracts the box member from the second member.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will be described below with reference to the drawings.

Figure 1:
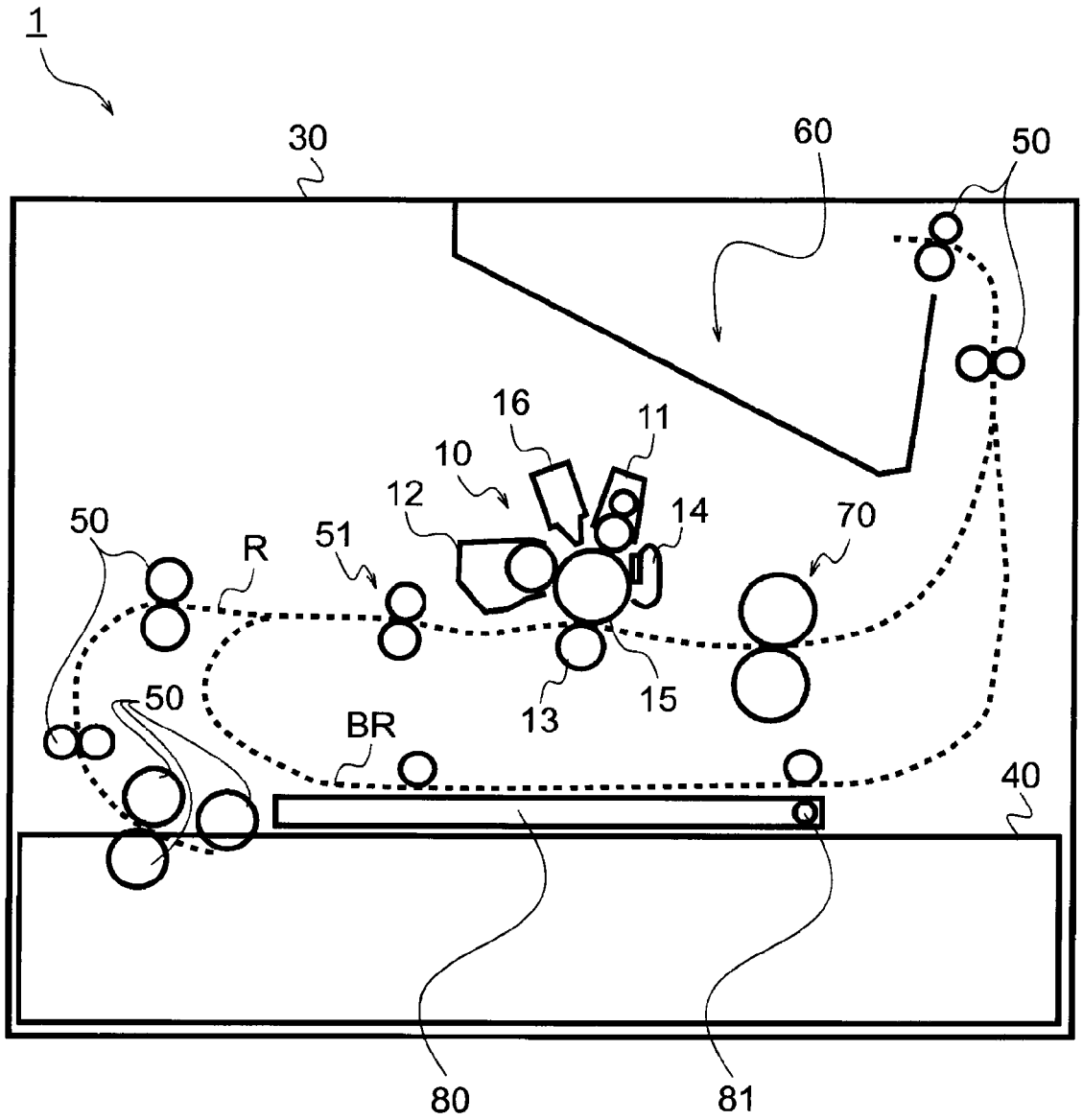
FIG. 1 illustrates a schematic configuration of a printer corresponding to an image forming apparatus according to an exemplary embodiment.

FIG. 1 illustrates a schematic configuration of a printer corresponding to an image forming apparatus according to an exemplary embodiment.

A printer 1 is a so-called monochrome printer, and includes one image engine 10. By way of example, the image engine 10 forms a toner image using an electrophotographic system, and is structured such that a charging unit 11, an exposure unit 16, a developing unit 12, a transfer unit 13, and a cleaner 14 are arranged in this order around a photoconductor 15 in a columnar shape.

In the image engine 10, the photoconductor 15 is sequentially subjected to charging executed by the charging unit 11, light exposure executed by the exposure unit 16, and development executed by the developing unit 12 so that a toner image is formed on the photoconductor 15.

A paper feed tray 40 that stores stacked sheets of paper that serves as a type of a recording material is provided in the lower part of the printer 1.

The paper is taken out of the paper feed tray 40 by transport rollers 50, and fed upward along a transport path R. Then, the paper is fed to resist rollers 51 by the transport rollers 50. The resist rollers 51 feed the paper to the image engine 10. The timing when the paper is fed to the image engine 10 matches the timing when a toner image is formed on the photoconductor 15. The toner image on the photoconductor 15 is transferred onto the paper by the transfer unit 13. The cleaner 14 removes a toner, paper powder, etc. that remains on the photoconductor 15 after the transfer.

The paper to which the image has been transferred is further transported on the transport path R to be fed to a fixing unit 70. The fixing unit 70 applies heat and pressure to the paper to fix the image on the paper to the paper.

In the case of so-called single-sided printing, the paper to which the image has been fixed is further transported upward, as it is, along the transport path R, and fed out of a housing 30 of the printer 1 by the transport rollers 50. The paper which has been fed out of the housing 30 is placed on a paper output tray 60 formed on the upper surface of the housing 30.

In the case of double-sided printing, on the other hand, the paper to which the image has been fixed is transported to a return path BR, and the paper is returned to the upstream side of the transport path R with the front and back surfaces of the paper reversed. Then, the toner image is transferred by the transfer unit 13, and the image is fixed by the fixing unit 70, to a surface on which an image is not formed yet, and the paper is fed out of the housing 30 of the printer 1 by the transport rollers 50.

The paper feed tray 40 is structured to be inserted into and extracted from the housing 30 of the printer 1 for replenishment of the paper. A bottom plate 80 that also serves as a guide member that guides transport of the paper is provided under the return path BR. The bottom plate 80 has a rotary shaft 81. In the case where a paper jam or the like is caused in the return path BR, the paper feed tray 40 is extracted, and the bottom plate 80 is rotated downward to be opened, which allows jamming paper or the like to be removed.

Figure 2:
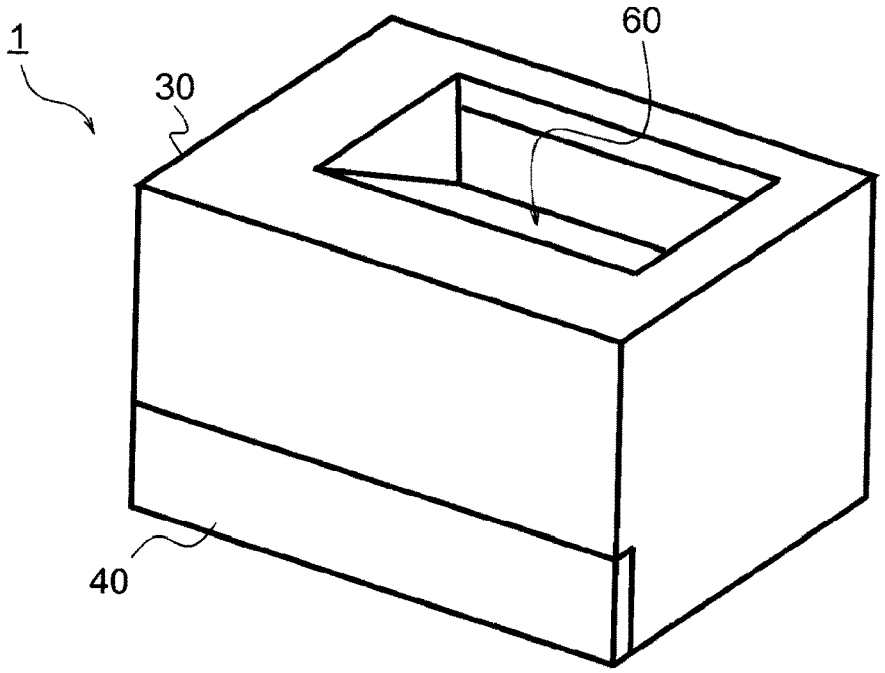
FIG. 2 illustrates a state in which a paper feed tray is inserted into the printer.
Figure 3:
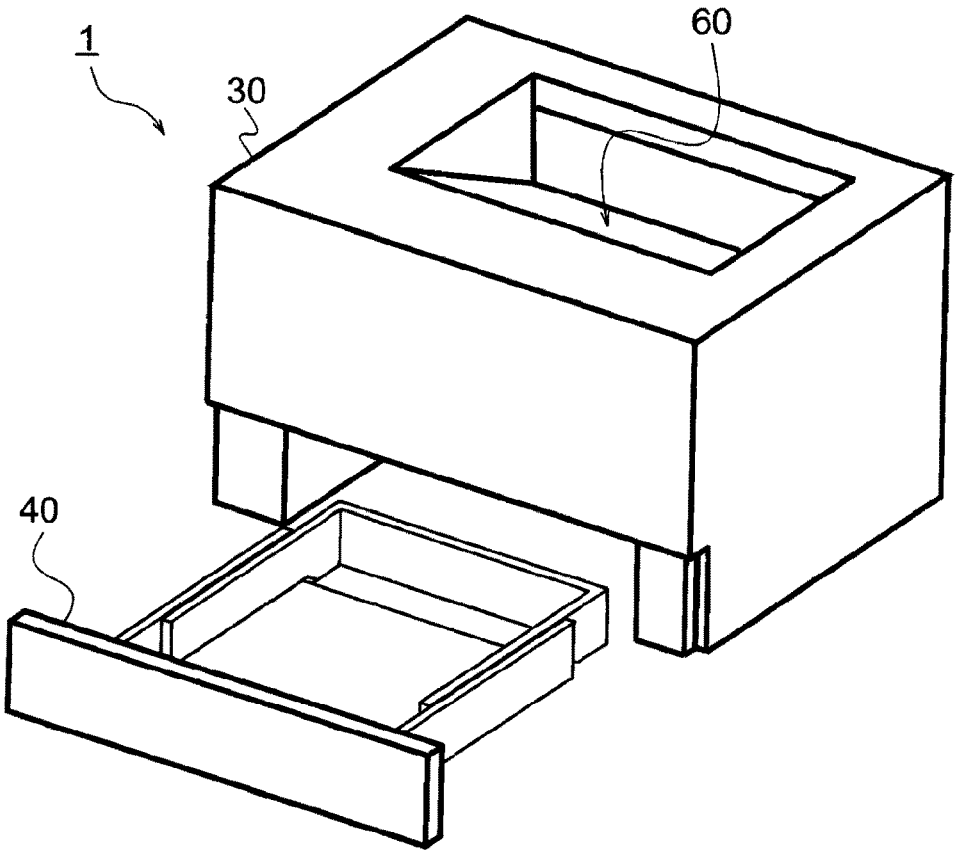
FIG. 3 illustrates a state in which the paper feed tray is drawn out of the printer.

FIGS. 2 and 3 illustrate a state in which the paper feed tray 40 is inserted into and extracted from the printer 1. FIG. 2 illustrates a state in which the paper feed tray 40 is inserted into the printer 1. FIG. 3 illustrates a state in which the paper feed tray 40 is drawn out of the printer 1.

The paper output tray 60 discussed above is formed on the upper surface of the housing 30 of the printer 1. The front surface of the printer 1, which corresponds to the left side in FIG. 1, is illustrated on the front side of FIGS. 2 and 3. The paper feed tray 40 is inserted into and drawn out of the printer 1 on the front surface side.

The printer 1 is an apparatus that forms an image on a plurality of types of paper of different sizes. In the case where the type of the paper is changed from the A4 size to a larger size such as the A3 size, for example, the size of the paper feed tray 40 is also changed. The size of the paper feed tray 40 may be changed by replacing the paper feed tray 40 with a paper feed tray 40 of a different size. In the present exemplary embodiment, however, the size of the paper feed tray 40 is changed by expanding and contracting the paper feed tray 40. The paper feed tray 40 corresponding to paper of a larger size corresponds to an example of a box member according to the present disclosure.

Figure 4:
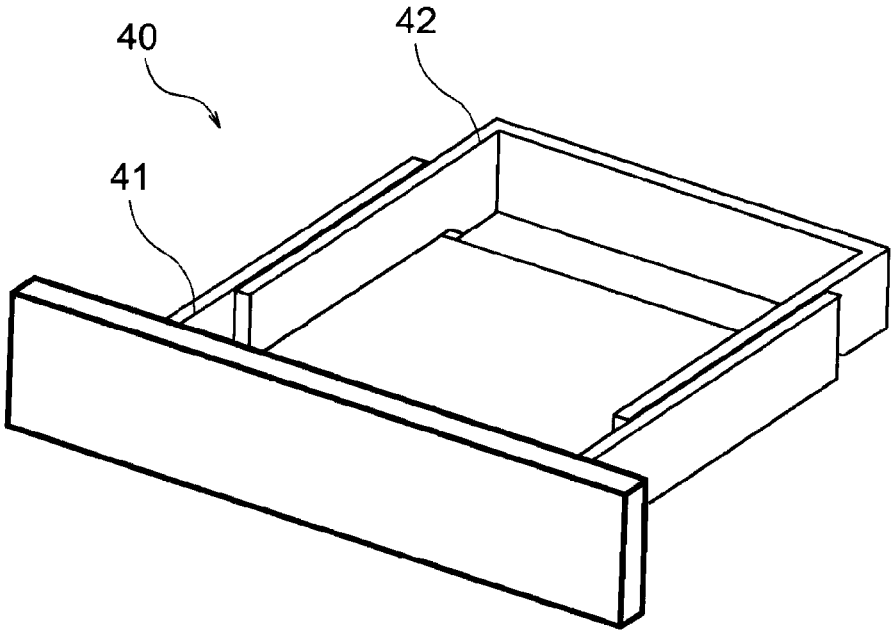
FIG. 4 illustrates the paper feed tray in a contracted state.
Figure 5:
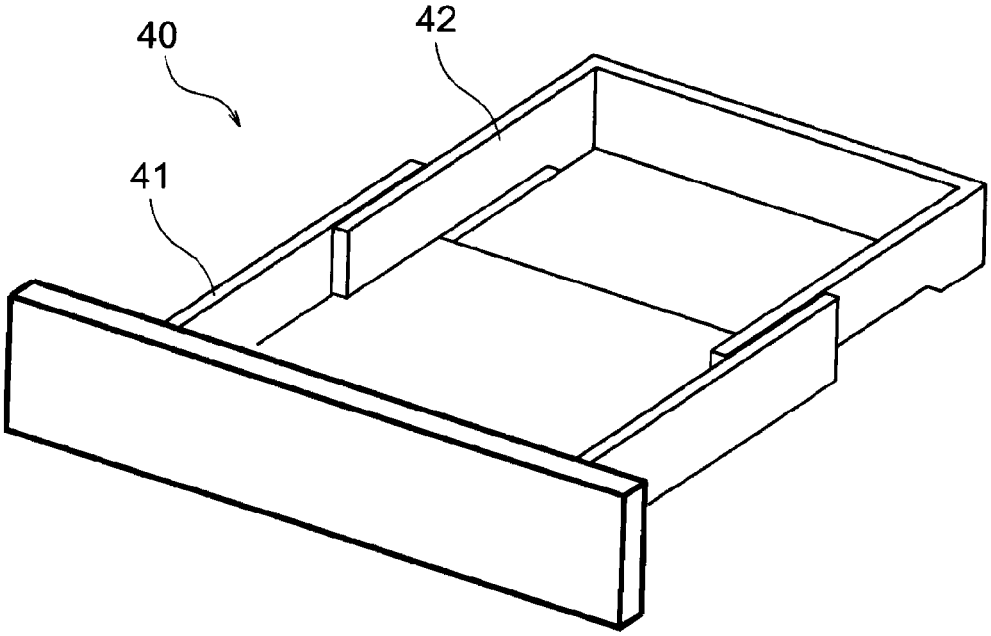
FIG. 5 illustrates the paper feed tray in an expanded state.

FIGS. 4 and 5 illustrate an expansion/contraction structure for the paper feed tray 40. FIG. 4 illustrates the paper feed tray 40 in a contracted state. FIG. 5 illustrates the paper feed tray 40 in an expanded state.

The paper feed tray 40 includes a front part 41 and a rear part 42, and the size of the paper feed tray 40 is changed by inserting the rear part 42 into or drawing the rear part 42 out of the front part 41. The paper feed tray 40 also includes a lock mechanism (not illustrated). In the case where the paper feed tray 40 is used in the contracted state illustrated in FIG. 4, for example, the positional relationship between the front part 41 and the rear part 42 is fixed by the lock mechanism. As a result, the size of the paper feed tray 40 is maintained even if the paper feed tray 40 is inserted into and drawn out of the printer 1.

The size of the printer 1 in the depth direction (i.e. the direction in which the paper feed tray 40 is inserted and drawn out) is determined so as to accommodate the paper feed tray 40 in the contracted state illustrated in FIG. 4. Therefore, when the paper feed tray 40 in the expanded state illustrated in FIG. 5 is inserted into the printer 1, a part of the paper feed tray 40 projects from the printer 1.

Figure 6:
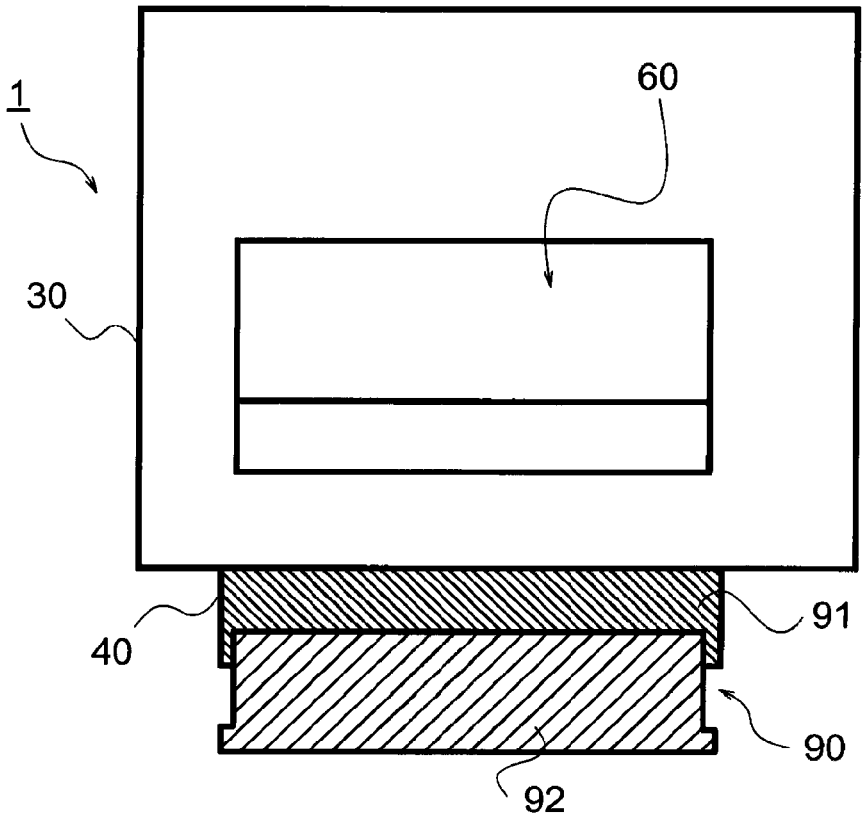
FIG. 6 is a top view illustrating a state in which the paper feed tray projects from the printer.

FIG. 6 is a top view illustrating a state in which the paper feed tray 40 projects from the printer 1.

FIG. 6 illustrates the printer 1 as seen from the upper side of the housing 30 on which the paper output tray 60 is provided. The upper side in FIG. 6 corresponds to the front side of the printer 1, and the lower side in FIG. 6 corresponds to the rear side of the printer 1.

When the paper feed tray 40 is inserted into the printer 1, the front surface side of the paper feed tray 40 is accommodated in the housing 30 of the printer 1, but a part of the rear side of the paper feed tray 40 projects from the housing 30. A covering 90 that covers the projecting portion is provided to suppress entry of dust or the like from the upper part of the paper feed tray 40 even in the case where the paper feed tray 40 projects from the housing 30 in this manner.

The covering 90 is expandable/contractible, and includes a front covering 91 and a rear covering 92. In the case where the paper feed tray 40 in the contracted state illustrated in FIG. 4 is used, the covering 90 is contracted and accommodated inside the housing 30. The bottom plate 80 illustrated in FIG. 1 is provided over the paper feed tray 40 inside the housing 30, and thus the covering 90 in the contracted state is housed compactly on the rear side of the bottom plate 80. The covering 90 corresponds to an example of a lid according to the present disclosure. The front covering 91 corresponds to an example of a first member according to the present disclosure. The rear covering 92 corresponds to an example of a second member according to the present disclosure.

The expandable/contractible structure of such an expandable/contractible covering 90 will be described below.

Figure 7:
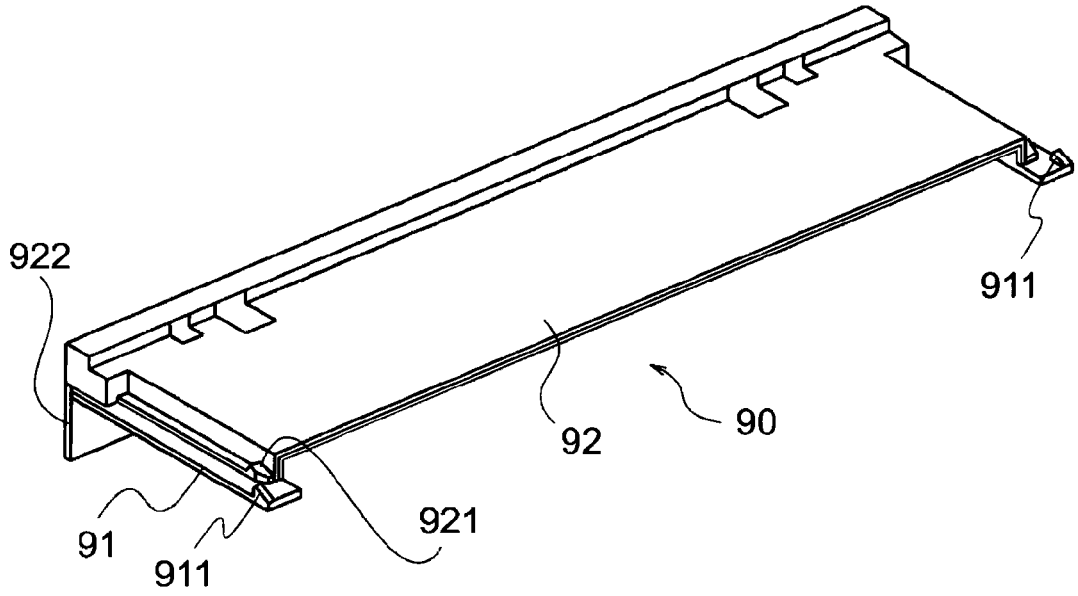
FIG. 7 illustrates the upper side of a covering in a contracted state.
Figure 8:
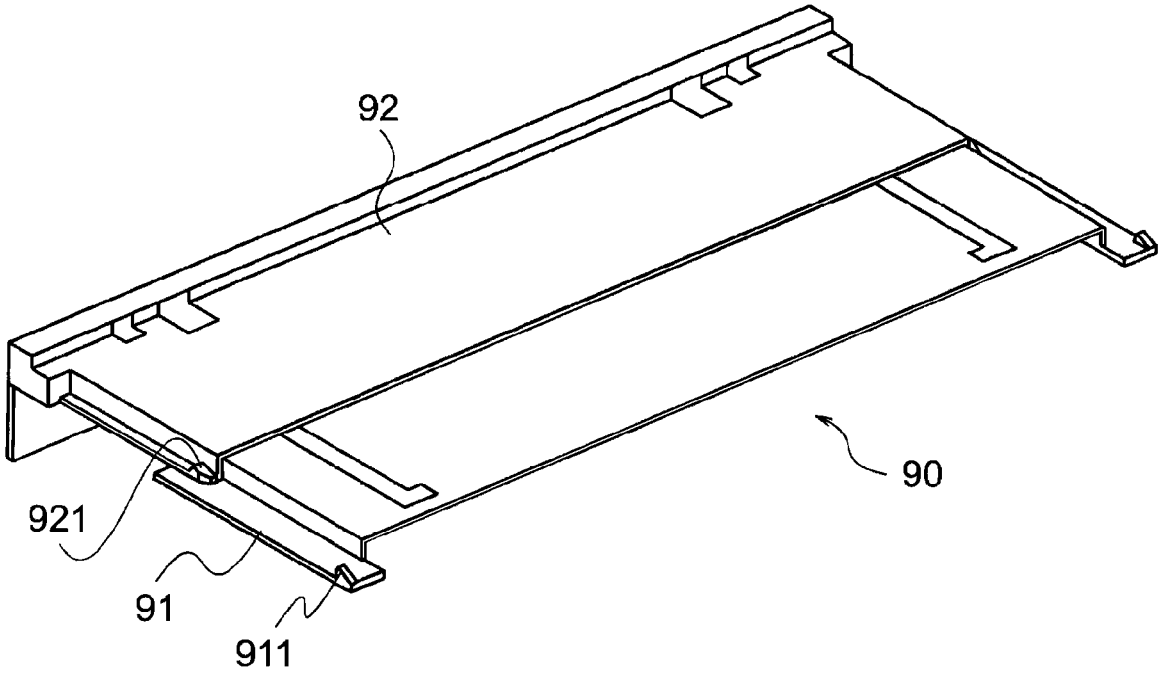
FIG. 8 illustrates the upper side of the covering in an expanded state.
Figure 9:
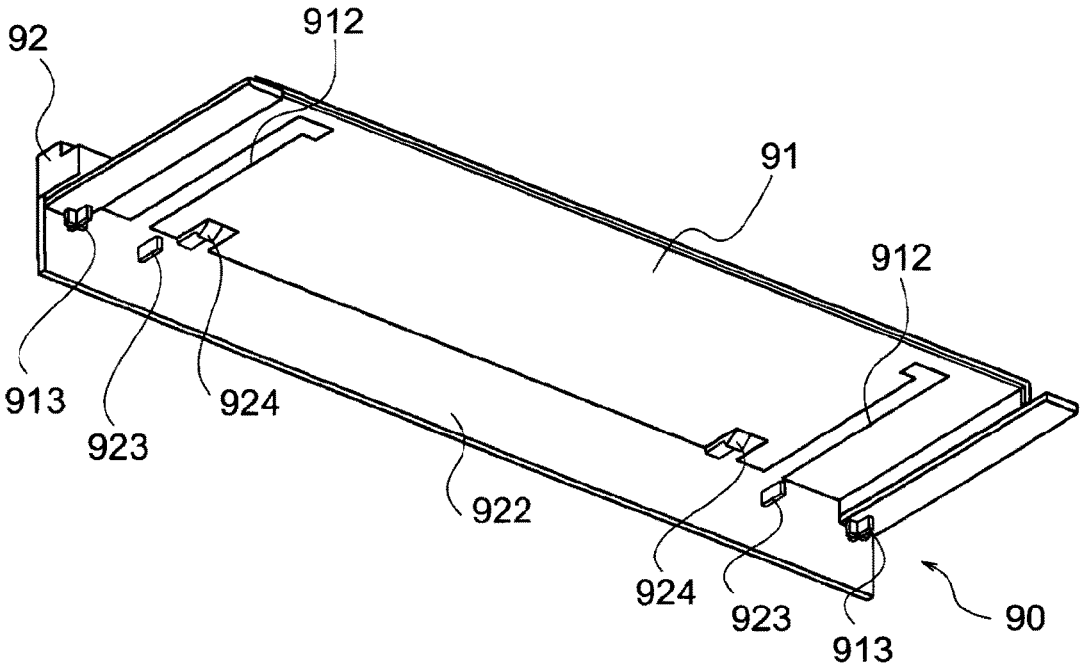
FIG. 9 illustrates the lower side of the covering in the contracted state.
Figure 10:
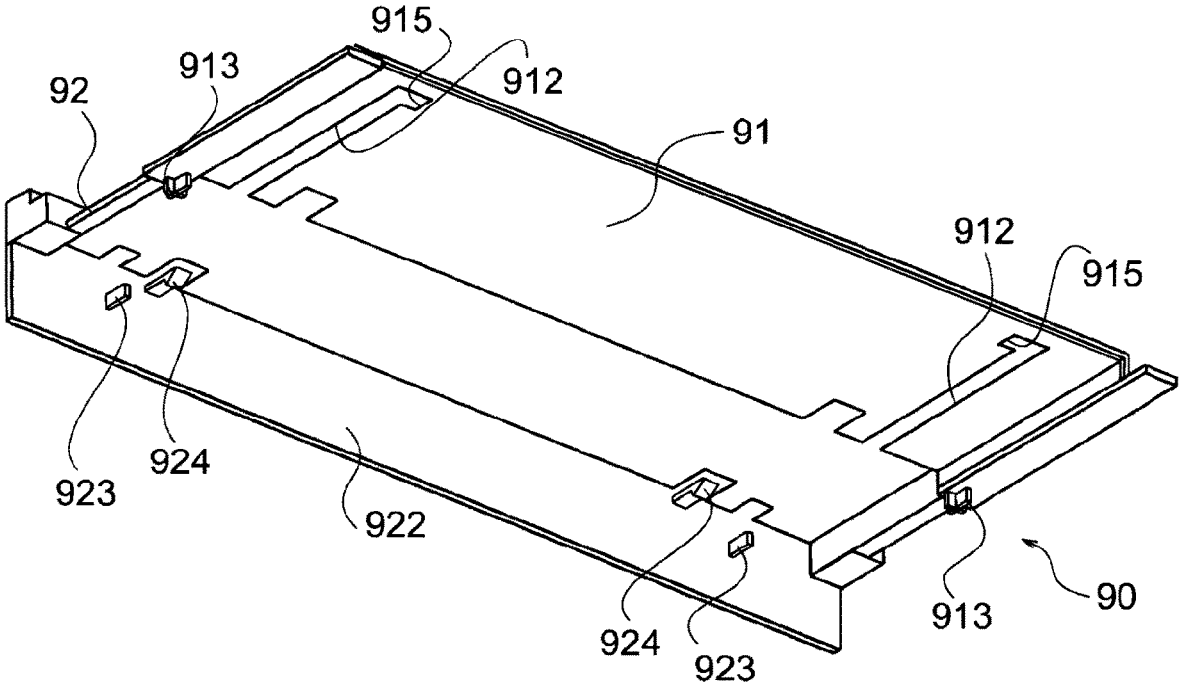
FIG. 10 illustrates the lower side of the covering in the expanded state.

FIGS. 7 to 10 illustrate the state of expansion and contraction of the covering 90. FIGS. 7 and 9 illustrate the covering 90 in a contracted state. FIGS. 8 and 10 illustrate the covering 90 in an expanded state. FIGS. 7 and 8 illustrate the upper side of the covering 90. FIGS. 9 and 10 illustrate the lower side of the covering 90.

In the covering 90 in the contracted state illustrated in FIGS. 7 and 9, the front covering 91 and the rear covering 92 vertically overlap each other to be in a compact form. In the covering 90 in the expanded state illustrated in FIGS. 8 and 10, meanwhile, the front covering 91 is slid with respect to the rear covering 92 to cover a large area.

A lug 911 for slip-off suppression to be engaged with the body of the printer 1 is formed at the front end of the front covering 91 to project upward. A lug 921 for snap engagement is provided at the front end of the rear covering 92 to project upward. The lug 921 for snap engagement corresponds to an example of a third lug according to the present disclosure.

A rear plate 922 that covers the rear part of the paper feed tray 40 is provided at the rear part of the rear covering 92. Bosses 923 and snaps 924 project forward from the rear plate 922. The bosses 923 correspond to an example of a back-side protrusion according to the present disclosure. The snaps 924 correspond to an example of a first lug according to the present disclosure.

In addition, the front covering 91 is provided with slits 912 for connection with the rear covering 92. Ribs 913 that project downward are provided at the lower portion of the front covering 91. The ribs 913 correspond to an example of a downward protrusion according to the present disclosure.

Figure 11:
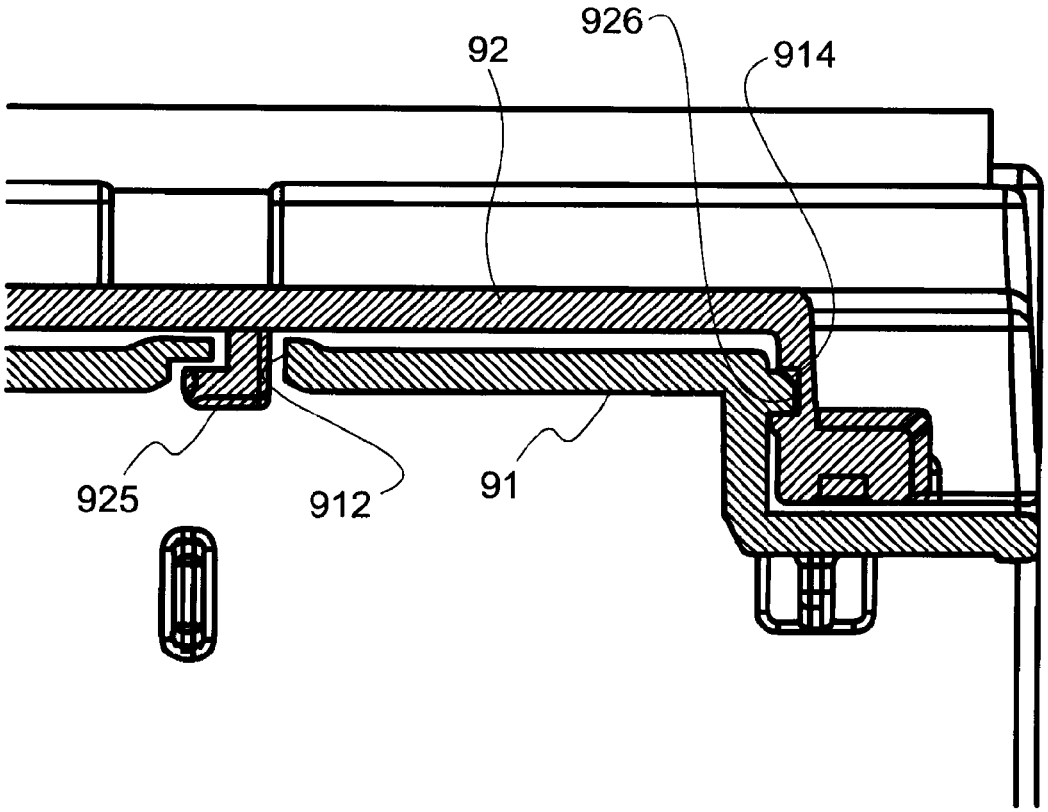
FIG. 11 is a sectional view illustrating a coupling structure between a front covering and a rear covering.

FIG. 11 is a sectional view illustrating a coupling structure between the front covering 91 and the rear covering 92.

A groove 926 is provided on the inner side of the rear covering 92. A rail 914 to be fitted with the groove 926 of the rear covering 92 is provided on a lateral side of the front covering 91. The front covering 91 and the rear covering 92 slide with respect to each other as guided by the groove 926 and the rail 914.

The rear covering 92 is provided with hooks 925 to be engaged with the edge of the slits 912 of the front covering 91. The hooks 925 correspond to an example of a second lug according to the present disclosure.

The hooks 925 are inserted form notches 915 (see FIG. 10) which are provided on the front side of the slits 912. The hooks 925 are moved toward the rear side of the slits 912 along the slits 912 as the front covering 91 is drawn out of the rear covering 92. Therefore, in the state in which the front covering 91 is drawn out of the rear covering 92, the front covering 91 and the rear covering 92 are firmly coupled to each other through the hooks 925. In addition, the slits are provided in the front covering 91. Thus, when the covering 90 is extended, the slits 912 are exposed to a lesser degree than in the case where the slits 912 are provided in the rear covering 92.

The covering 90 which is expandable/contractible and which includes the front covering 91 and the rear covering 92 is expanded by inserting the paper feed tray 40 into the printer 1, and contracted by drawing the paper feed tray 40 out of the printer 1.

When the paper feed tray 40 is pressed against the rear covering 92, the rear covering 92 and the paper feed tray 40 are connected to each other. This connection achieves expansion and contraction of the covering 90.

Figure 12:
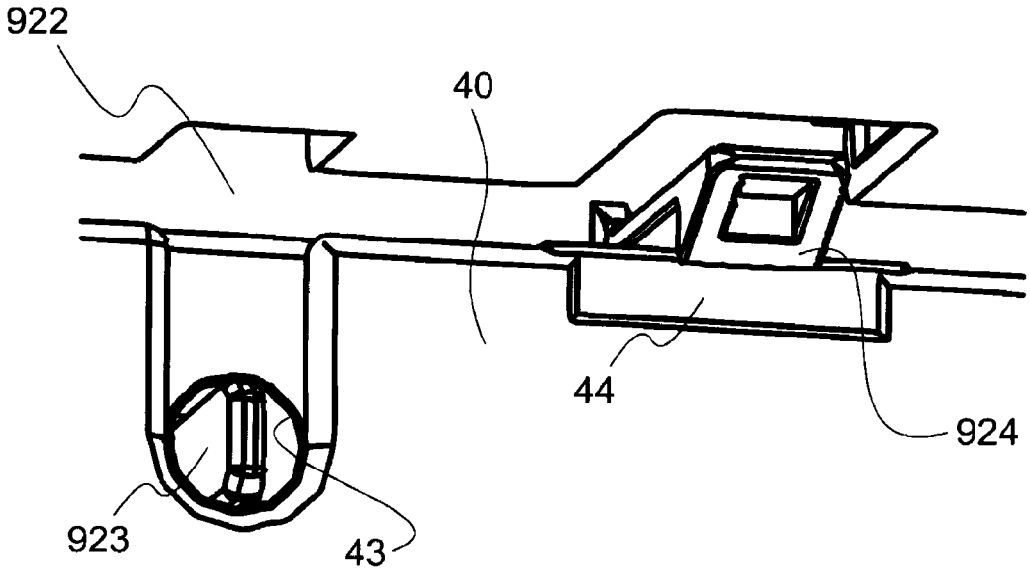
FIG. 12 illustrates a structure of connection between the rear covering and the rear part of the paper feed tray.

FIG. 12 illustrates a structure of connection between the rear covering 92 and the rear part of the paper feed tray 40.

When the paper feed tray 40 is pressed against the rear covering 92, the bosses 923 which project from the rear plate 922 of the rear covering 92 advance into boss holes 43 formed on the rear side of the paper feed tray 40. When the paper feed tray 40 is pressed against the rear covering 92, in addition, the snaps 924 which project from the rear plate 922 of the rear covering 92 are engaged with edges 44 for snap engagement, which are provided on the rear side of the paper feed tray 40, to connect the paper feed tray 40 and the rear covering 92 to each other. This connection is achieved by the snaps 924, and therefore releasable.

Expanding and contracting operation of the covering 90 accompanied by insertion and extraction of the paper feed tray 40 will be described below.

Figure 13:
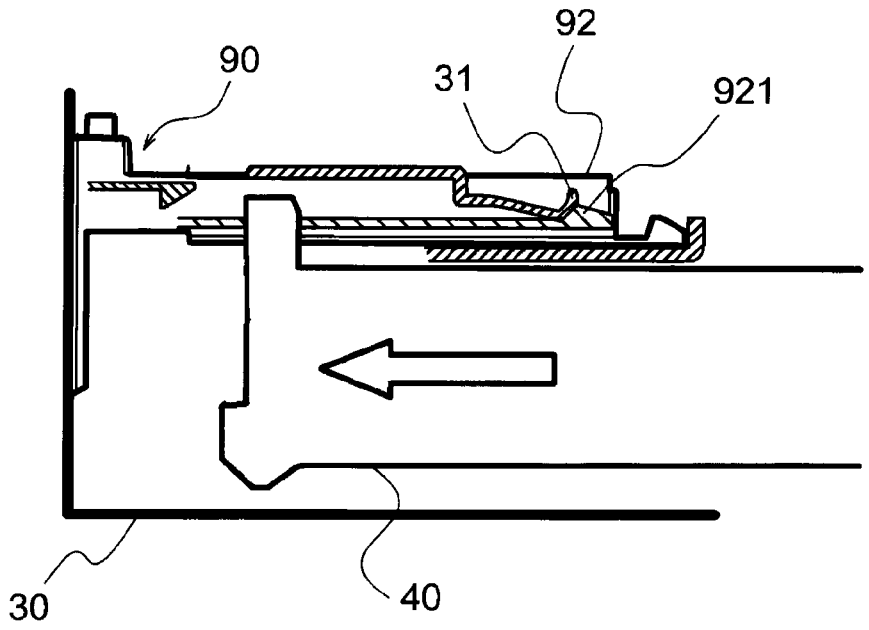
FIG. 13 illustrates a first stage of insertion of the paper feed tray into a housing.

FIG. 13 illustrates a first stage of insertion of the paper feed tray 40 into the housing 30.

When insertion of the paper feed tray 40 is started, the covering 90 is housed inside the housing 30. The lugs 921 of the rear covering 92 are engaged with snaps 31 for slip-off suppression provided in the housing 30.

The paper feed tray 40 advances toward the rear side of the housing 30 under the covering 90.

Figure 14:
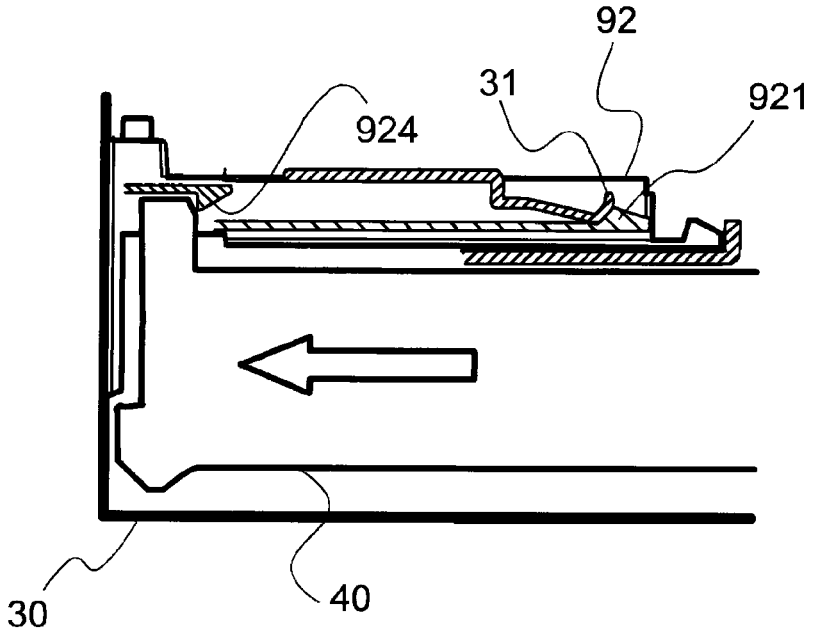
FIG. 14 illustrates a second stage of insertion of the paper feed tray into the housing.

FIG. 14 illustrates a second stage of insertion of the paper feed tray 40 into the housing 30.

When insertion of the paper feed tray 40 progresses, the rear end of the paper feed tray 40 reaches the rear of the housing 30, and the edge of the paper feed tray 40 reaches the snaps 924 of the rear covering 92. At this time, the lugs 921 of the rear covering 92 are engaged with the snaps 31, and a force for the lugs 921 to slip out of the snaps 31 is stronger than a force for the snaps 924 of the rear covering 92 to be engaged with the edge of the paper feed tray 40. Therefore, the snaps 924 of the rear covering 92 are engaged with the edge of the paper feed tray 40 without the rear covering 92 slipping out of the housing 30. At this time, as illustrated in FIG. 12, the bosses 923 which project from the rear plate 922 of the rear covering 92 advance into the boss holes 43 of the paper feed tray 40.

Figure 15:
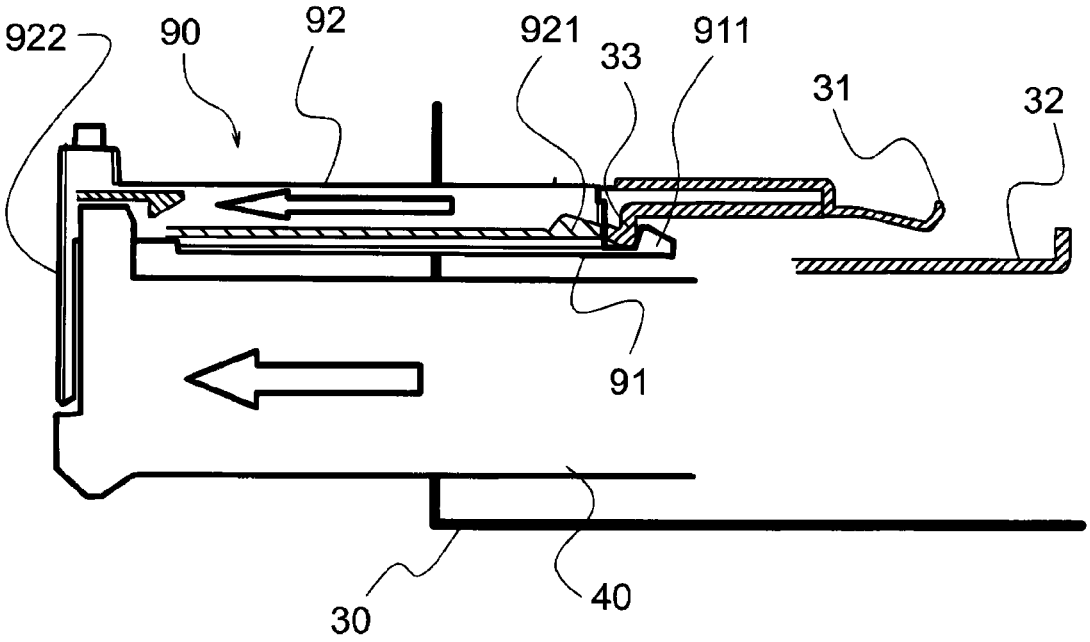
FIG. 15 illustrates a third stage of insertion of the paper feed tray into the housing.

FIG. 15 illustrates a third stage of insertion of the paper feed tray 40 into the housing 30.

When the paper feed tray 40 is further inserted into the housing 30, the paper feed tray 40 contacts the rear plate 922 of the rear covering 92 to push the rear covering 92. This force disengages the lugs 921 of the rear covering 92 from the snaps 31 for slip-off suppression, and the covering 90 is moved rearward along the guide rails 32 which are provided in the housing 30.

When the covering 90 is moved rearward to a certain degree, the lugs 911 of the front covering 91 contact stoppers 33 provided in the housing 30, and movement of the front covering 91 is stopped.

Figure 16:
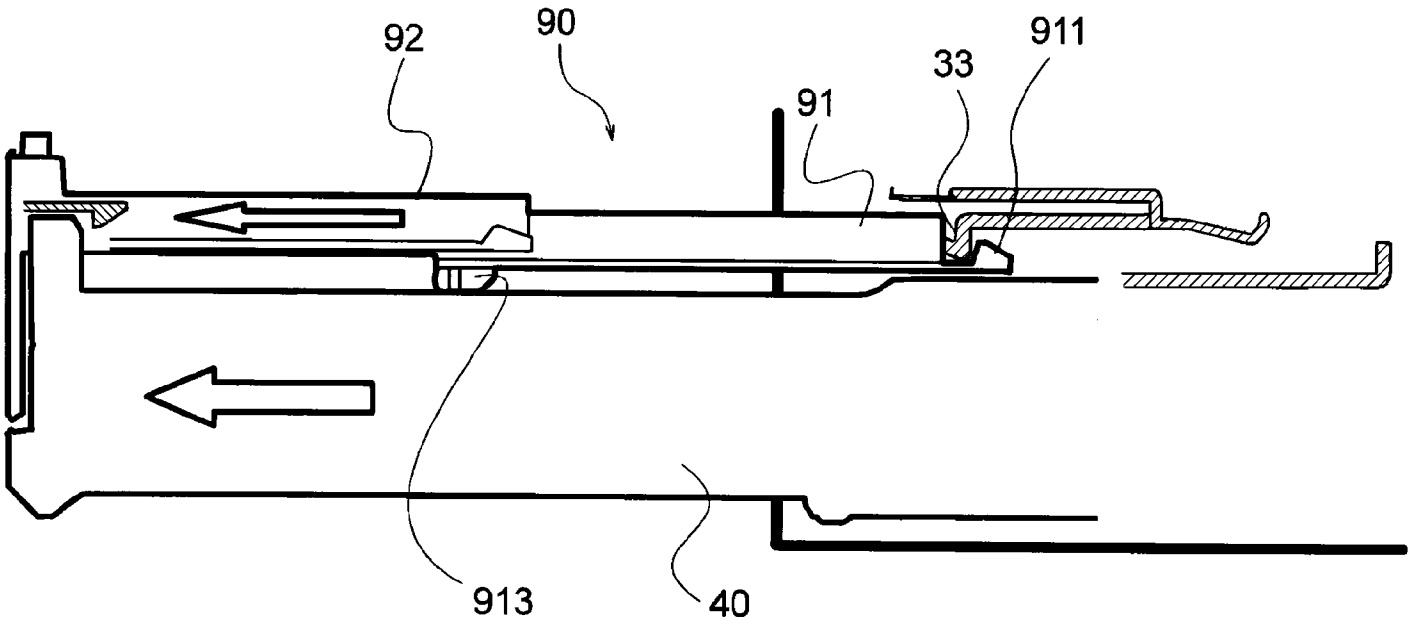
FIG. 16 illustrates a fourth stage of insertion of the paper feed tray into the housing.

FIG. 16 illustrates a fourth stage of insertion of the paper feed tray 40 into the housing 30.

When the paper feed tray 40 is further inserted into the housing 30, the rear covering 92 is pushed by the paper feed tray 40 to be moved rearward with the front covering 91 stopped by the lugs 911. As a result, the covering 90 is extended.

In the case where the covering 90 is extended, the ribs 913 of the front covering 91 contact the edge of the paper feed tray 40 at a position in the middle of the covering 90. In the case where the covering 90 is extended in this manner, the rear part of the covering 90 is not disengaged from the paper feed tray 40 because of the connection between the bosses 923 and the boss holes 43 discussed above.

Figure 17:
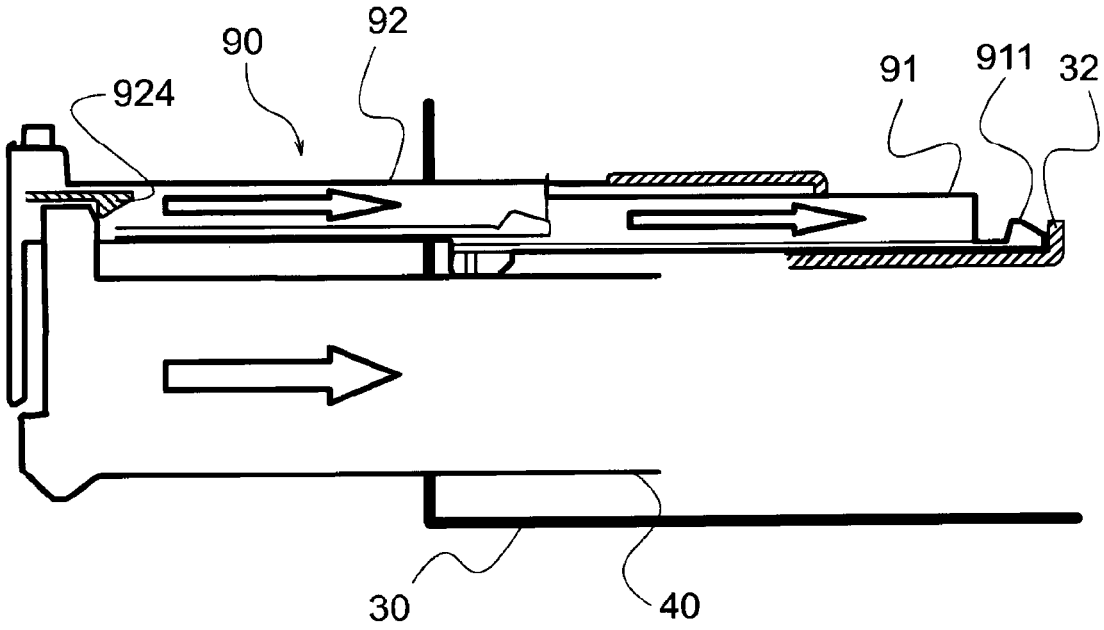
FIG. 17 illustrates a first stage of extraction of the paper feed tray from the housing.

FIG. 17 illustrates a first stage of extraction of the paper feed tray 40 from the housing 30.

When the paper feed tray 40 starts being drawn out of the housing 30, the entire covering 90 is drawn into the housing 30 by a force of engagement of the edge at the rear end of the paper feed tray 40 with the snaps 924 of the rear covering 92. The covering 90 is moved forward along the guide rails 32 in the housing, and the lugs 911 of the front covering 91 reach the front end of the guide rails 32. When the lugs 911 reach the front end of the guide rails 32, movement of the front covering 91 is stopped.

Figure 18:
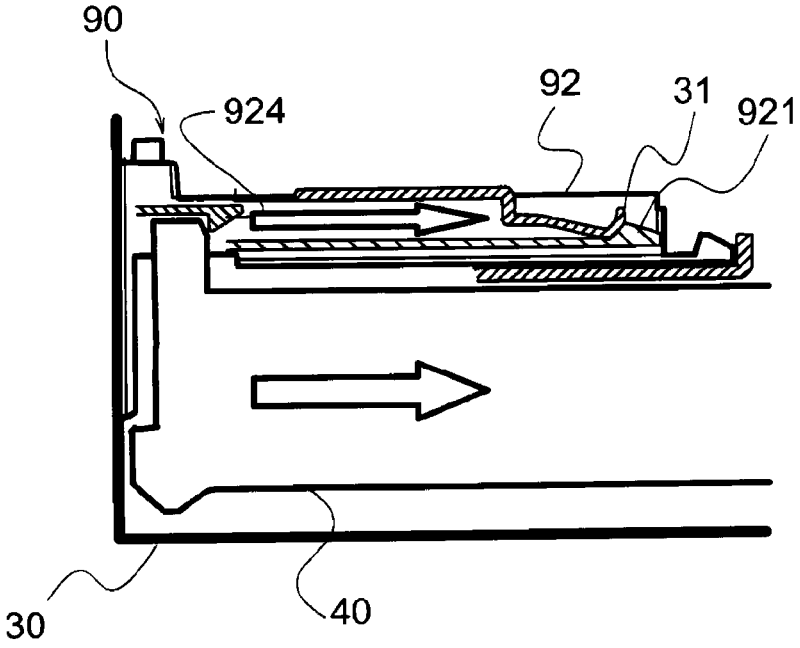
FIG. 18 illustrates a second stage of extraction of the paper feed tray from the housing.

FIG. 18 illustrates a second stage of extraction of the paper feed tray 40 from the housing 30.

When the paper feed tray 40 is further drawn out of the housing 30, the rear covering 92 is drawn into the housing 30, and the covering 90 is contracted. Then, the lugs 921 of the rear covering 92 reach the snaps 31 which are provided in the housing 30. A force for the lugs 921 of the rear covering 92 to be engaged with the snaps 31 is weaker than a force for the snaps 924 of the rear covering 92 to be disengaged from the edge of the paper feed tray 40, and thus the lugs 921 of the rear covering 92 are engaged with the snaps 31 by a force for the paper feed tray 40 to draw the rear covering 92. As a result, the covering 90 is housed in the housing 30.

Figure 19:
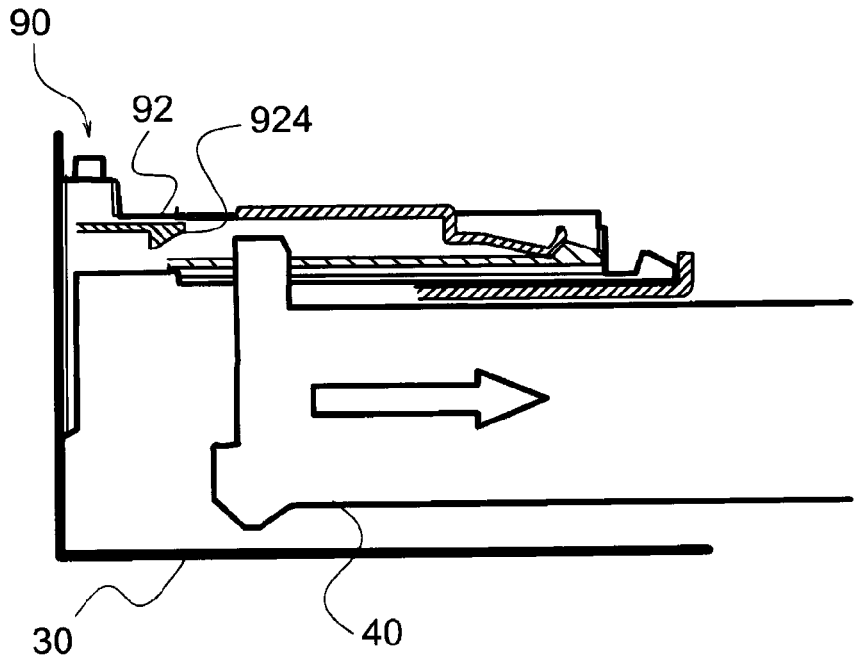
FIG. 19 illustrates a third stage of extraction of the paper feed tray from the housing.

FIG. 19 illustrates a third stage of extraction of the paper feed tray 40 from the housing 30.

When the covering 90 is accommodated in the housing 30, movement of the covering 90 is stopped, and the edge of the paper feed tray 40 is disengaged from the snaps 924 of the rear covering 92. Then, the paper feed tray 40 is moved under the covering 90 to be drawn toward the front side of the housing 30.

In this manner, the covering 90 is automatically expanded and contracted along with insertion of the paper feed tray 40 into and extraction of the paper feed tray 40 from the housing 30.

The covering 90 is separable from the housing 30 as necessary during maintenance or the like, for example. Therefore, the covering 90 and the housing 30 are removably mounted to each other.

Figure 20:
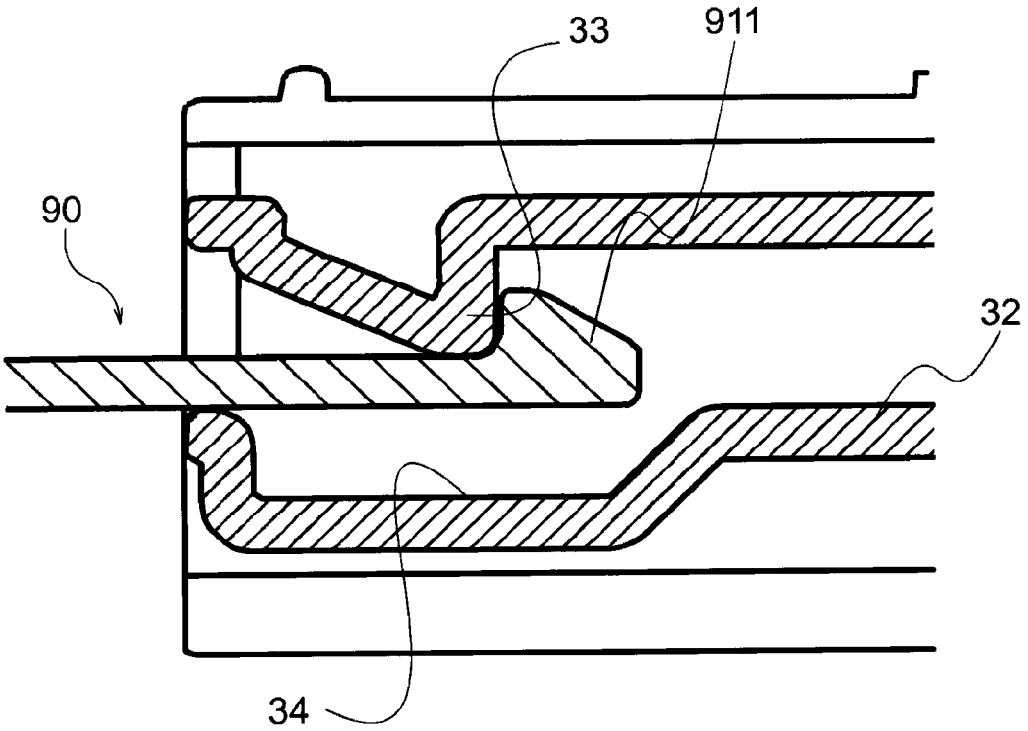
FIG. 20 illustrates a state in which the covering is held by the housing.
Figure 21:
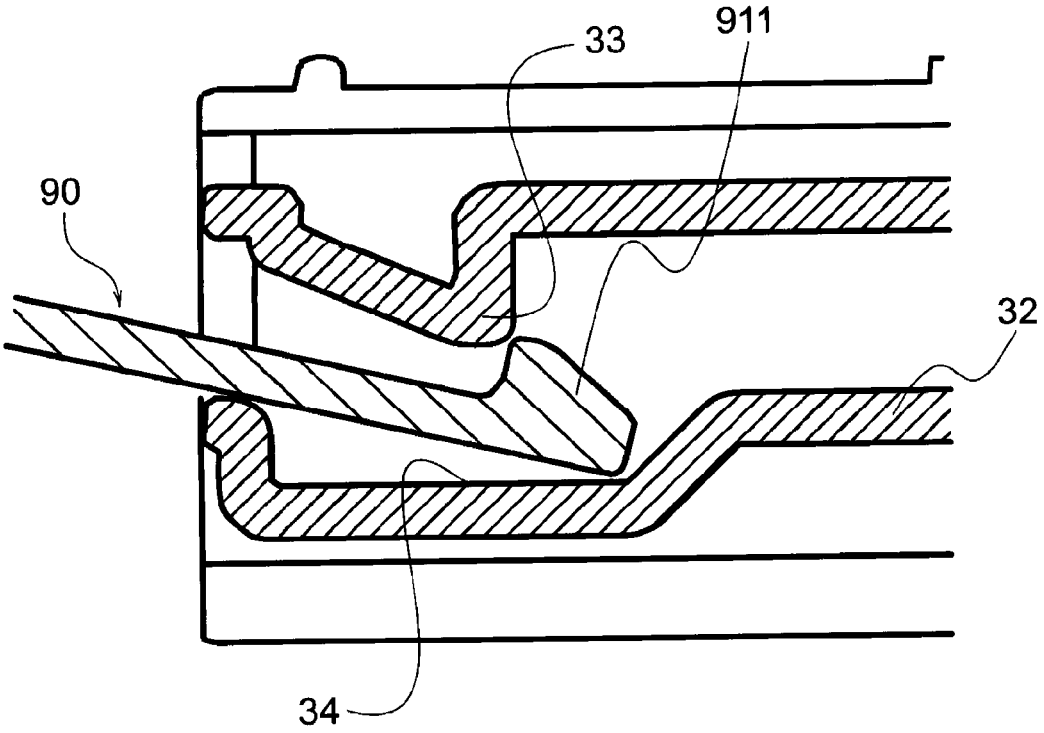
FIG. 21 illustrates a state in which the covering is disengaged from the housing.

FIGS. 20 and 21 illustrate the removable mounting structure between the covering 90 and the housing 30. FIG. 20 illustrates a state in which the covering 90 is held by the housing 30. FIG. 21 illustrates a state in which the covering 90 is detachable from the housing 30.

The covering 90 is held by the housing 30 with the lugs 911 for slip-off suppression engaged with the stoppers 33 in the housing 30. The guide rails 32 which guide movement of the covering 90 are provided in the housing 30, and recesses 34 are formed in the vicinity of the guide rails 32.

When the covering 90 is separated from the housing 30, the rear portion of the covering 90 is lifted up, and the lugs 911 for slip-off suppression are lowered to be inserted into the recesses 34 of the guide rails 32. As a result, the lugs 911 are disengaged form the stoppers 33, which allows the covering 90 to be separated from the housing 30.

Figure 22:
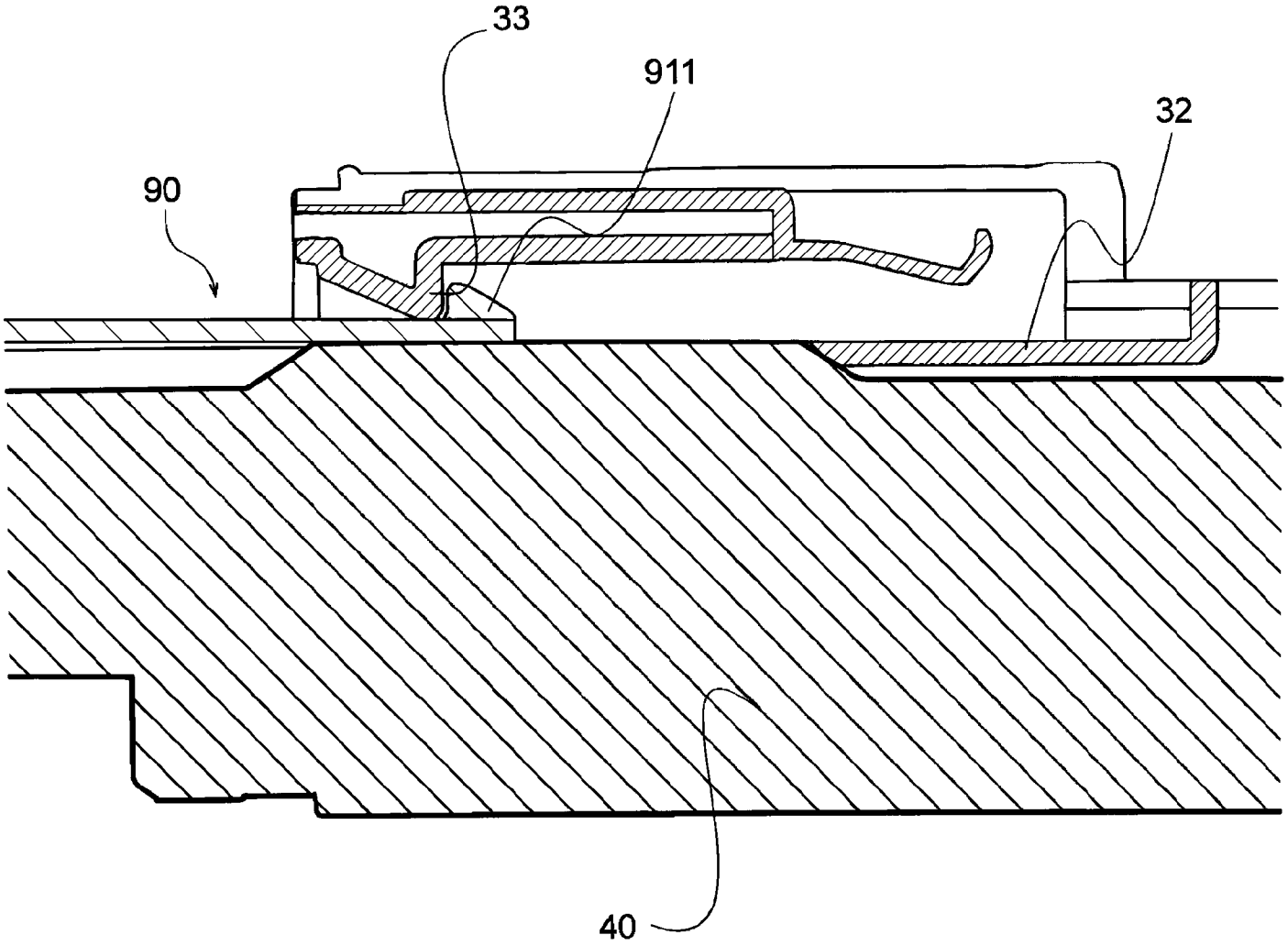
FIG. 22 illustrates a removable mounting structure with the paper feed tray inserted.

FIG. 22 illustrates a removable mounting structure with the paper feed tray 40 inserted.

When the paper feed tray 40 is inserted, as discussed above, the rear part of the covering 90 is connected to the rear part of the paper feed tray 40 not to be lifted up.

When the paper feed tray 40 is inserted, in addition, the edge of the paper feed tray 40 blocks the positions of the recesses 34 of the guide rails 32. Thus, entry of the lugs 911 into the recesses 34 is hindered.

As a result, in the case where the paper feed tray 40 is inserted, the covering 90 may not be disengaged from the paper feed tray 40 or extracted from the housing 30.

In the above description, the rear covering 92 which has the rear plate 922 is described as an example of a second member according to the present disclosure. However, the second member according to the present disclosure may cover only the upper part of the box member.

In the above description, in addition, the rear covering 92 is placed on the front covering 91. However, any of the first member and the second member according to the present disclosure may be placed on the other. The first member and the second member according to the present disclosure are each not limited to an integrally molded article. The first member and the second member may each be a member formed by assembling a plurality of parts to each other.

In the above description, an electrophotographic image engine is described as an example of an image forming portion according to the present disclosure. However, the image forming portion according to the present disclosure may be an image engine that forms an image using an inkjet system or the like.

In the above description, in addition, a monochrome printer is described as an image forming apparatus according to an exemplary embodiment of the present disclosure. However, the image forming apparatus according to the present disclosure may be a color printer, a copier, a facsimile, or a multi-function device.

The present disclosure has been made for the purpose of addressing the issue described in the "Summary" section. However, the configuration according to the present disclosure may also be used for other purposes that do not address the above issue, and aspects in which the configuration according to the present disclosure are used for such purposes are also exemplary embodiments of the present disclosure.

What is claimed is:

1. A medium supply apparatus comprising:

a box member inside which a medium is stored and which is inserted into and extracted from a body of an image forming apparatus, the box member having a length in an extraction/insertion direction that is longer than a length of the body in the extraction/insertion direction; and a lid provided on a back side of the body in the extraction/insertion direction of the box member to cover at least an upper part of a portion of the box member that projects from the body, wherein the lid includes a first member that is movable in the extraction/insertion direction with respect to the body, a second member connected to the first member so as to be relatively movable in the extraction/insertion direction with respect to the first member, the second member being moved by being pushed by the box member which is inserted into the body, and a first lug provided on the second member, the first lug being engaged with the box member by a force that presses the box member against the second member and disengaged from the box member by a force that extracts the box member from the second member, wherein the box member has a hole that faces the back side, and the lid includes a back-side protrusion provided on the second member and projecting from the back side toward the box member to be fitted with the hole, and the lid includes a second lug that projects from one of the first member and the second member to be engaged with the other, and the other has a groove that extends in the extraction/insertion direction and that has an edge with which the second lug is engaged, and wherein a notch that allows passage of the second lug during assembly of the lid is provided at the edge of the groove at an end portion of the groove on a front side opposite to a rear side of the groove.

2. The medium supply apparatus according to claim 1, wherein the lid is separated from the body when a rear portion of the lid is lifted up.

3. The medium supply apparatus according to claim 1, wherein the second lug is provided on the second member, and the groove is provided in the first member.

4. The medium supply apparatus according to claim 1, wherein the lid includes a downward protrusion that projects downward from one of the first member and the second member that is positioned on a lower side to contact an edge of the box member.

5. The medium supply apparatus according to claim wherein the lid includes a third lug that projects from the second member to be engaged with the body.

6. The medium supply apparatus according to claim 5, wherein the third lug is disengaged from the body when the second member is extracted from the body with a force that is stronger than the force that presses the box member for engagement of the first lug, and engaged with the body when the second member is pushed toward the body by a force that is weaker than the force that extracts the box member for disengagement of the first lug.

7. An image forming apparatus comprising:

a medium supply apparatus including a box member inside which a medium is stored and which is inserted into and extracted from a body of the image forming apparatus, the box member having a length in an extraction/insertion direction that is longer than a length of the body in the extraction/insertion direction, and a lid provided on a back side of the body in the extraction/insertion direction of the box member to cover at least an upper part of a portion of the box member that projects from the body, wherein the lid includes a first member that is movable in the extraction/insertion direction with respect to the body, a second member connected to the first member so as to be relatively movable in the extraction/insertion direction with respect to the first member, the second member being moved by being pushed by the box member which is inserted into the body, and a first lug provided on the second member, the first lug being engaged with the box member by a force that presses the box member against the second member and disengaged from the box member by a force that extracts the box member from the second member; and an image forming portion incorporated in the body to form an image on the medium which is supplied from the medium supply apparatus, wherein the box member has a hole that faces the back side, and the lid includes a back-side protrusion provided on the second member and projecting from the back side toward the box member to be fitted with the hole, and the lid includes a second lug that projects from one of the first member and the second member to be engaged with the other, and the other has a groove that extends in the extraction/insertion direction and that has an edge with which the second lug is engaged, and wherein a notch that allows passage of the second lug during assembly of the lid is provided at the edge of the groove at an end portion of the groove on a front side opposite to a rear side of the groove.

8. A medium supply apparatus comprising:

a box member inside which a medium is stored and which is inserted into and extracted from a body of an image forming apparatus, the box member having a length in an extraction/insertion direction that is longer than a length of the body in the extraction/insertion direction; and a lid provided on a back side of the body in the extraction/insertion direction of the box member to cover at least an upper part of a portion of the box member that projects from the body, wherein the lid includes a first member that is movable in the extraction/insertion direction with respect to the body, a second member connected to the first member so as to be relatively movable in the extraction/insertion direction with respect to the first member, the second member being moved by being pushed by the box member which is inserted into the body, and a first lug provided on the second member, the first lug being engaged with the box member by a force that presses the box member against the second member and disengaged from the box member by a force that extracts the box member from the second member, wherein the box member has a hole that faces the back side, and the lid includes a back-side protrusion provided on the second member and projecting from the back side toward the box member to be fitted with the hole, wherein the lid includes a third lug that projects from the second member to be engaged with the body.

* * * * *